US005383571A

United States Patent [19]

Gunderson

[11] Patent Number: 5,383,571

[45] Date of Patent: Jan. 24, 1995

[54] LID DISPENSER

[75] Inventor: Jeffrey E. Gunderson, Stoughton, Wis.

[73] Assignee: Acry Fab Inc., Sun Prairie, Wis.

[21] Appl. No.: 134,554

[22] Filed: Oct. 8, 1993

[51] Int. Cl.[6] ..... B65H 3/28

[52] U.S. Cl. ..... 221/223; 221/297

[58] Field of Search ..... 221/221, 223, 297, 268, 221/276, 232, 191, 194, 195, 241, 242, 279, 40

[56] References Cited

U.S. PATENT DOCUMENTS

| | | | |
|---|---|---|---|
| 1,083,727 | 1/1914 | Claussen | 221/221 |
| 1,261,950 | 4/1918 | Luellen | 221/221 |
| 1,636,208 | 7/1927 | Bergmann | 221/223 |
| 1,660,247 | 2/1928 | Wooten et al. | 221/261 |
| 2,539,652 | 1/1951 | Amberg et al. | 221/251 |
| 2,946,480 | 7/1960 | Farber | 221/242 |
| 3,904,077 | 9/1975 | Luginbuhl | 221/175 |
| 3,906,703 | 9/1975 | Heisler | 53/42 |
| 4,033,478 | 7/1977 | House | 221/279 |
| 4,741,458 | 5/1988 | Odorici | 221/221 |
| 4,949,526 | 8/1990 | Brogna et al. | 53/306 |
| 5,000,345 | 3/1991 | Brogna et al. | 221/221 |
| 5,012,952 | 5/1991 | Franz | 221/36 |
| 5,038,969 | 8/1991 | Berger | 221/40 |

*Primary Examiner*—Kenneth W. Noland

*Attorney, Agent, or Firm*—Lathrop & Clark

[57] ABSTRACT

A trough-like support piece extends within a supply tube in a housing and supports a stack of beverage container lids. A spring biases a plate to urge the stack frontwardly to engage against a plurality of spring-loaded members which extend from the housing frontwardly of the plate. A cover is hinged to the housing and has two guide rods which extend rearwardly toward the lids. Three plastic claws are flexibly supported on a support member which is mounted front-to-back movement on the guide rods. A pull rod extends from the support member through the cover and is biased rearwardly by a spring. Each claw member is connected by flexible bands to claw stops, and the claws are thus positioned to engage with the frontmost lid of the stack. A user by pulling on the dispensing handle causes the claws to move frontwardly to extract a single lid and drop it onto inclined supports removal by a user. By use of such a dispenser in convenience stores and the like contact by customers with lids other than those dispensed is avoided.

18 Claims, 5 Drawing Sheets

LID DISPENSER

FIELD OF THE INVENTION

This invention relates to apparatus for dispensing articles in general, and to apparatus for dispensing individual beverage container lids in particular.

BACKGROUND OF THE INVENTION

Untended selection of goods is increasingly popular with consumers. From petroleum to food products, purchasers appreciate the immediate satisfaction and lowered cost provided by self-service. Many convenience stores and restaurants provide cafeteria line or serve-yourself type vending of prepared food, often for take-out or on-the-road consumption. Beverages dispensed from a fountain are typically served in paper or plastic cups, which, to prevent spilling, are provided with molded plastic lids. These lids have a resilient flange which snaps into engagement with a bead formed in the lip of the beverage container. Individual cup dispensers have long been available which permit the removal of a single cup without contamination or disturbance of the remaining supply. Container lids, however, differ from cups in that no deep graspable surface is provided.

In order to prevent contamination of the lid supply, especially where multiple users will be drawing on the supply, it is essential that the dispenser isolate the supply of lids from the single lid dispensed. Furthermore, to reduce litter and waste, it is desirable that a dispenser dispense only one lid at a time, a goal complicated by the fact that the resilient plastic lids have a tendency to stick together.

One known lid dispenser utilizes a tightly coiled spring disposed above a dispensing opening, with an attached lever which may be depressed to release a frontmost lid for selection by a consumer. Such a device undesirably permits consumer contact with the supply, and may not deliver the desired repeatable performance in dispensing. Other known dispensers engage the underside of a lid and through a series of linkages extract a single lid. These mechanically complicated devices tend to be overly voluminous and consume excessive countertop space.

What is needed is a compact lid dispenser which repeatably dispenses single lids from a supply which is isolated from contact with the user.

SUMMARY OF THE INVENTION

The lid dispenser of the present invention has a trough-like lid support piece which extends within a supply tube in a housing and supports a stack of beverage container lids. A spring biases a plate to urge the stack frontwardly to engage against a plurality of spring-loaded members which extend from the housing frontwardly of the plate. These members, or pagers, which allow only a single lid to be dispensed at a time, are locked against frontward pivoting, but may freely pivot rearwardly for convenient loading of the lid supply tube. A cover is hinged to the housing and has two guide rods which extend rearwardly toward the lids. Three plastic claws are flexibly supported on a support member which is mounted for front-to-back movement on the guide rods. A pull rod extends from the support member through the cover and is biased rearwardly by a spring. Each claw member is connected by flexible bands to positionable fasteners which are fixed in radial slots in the support member which allow some radial movement of the claws as they engage a cover. Depth stops extend from the claws and position them with respect to the frontmost lid of the stack. A user, by pulling on the dispensing handle, causes the claws to move frontwardly to extract a single lid and drop it onto inclined supports for removal by a user. By use of such a dispenser in convenience stores and the like contact by customers with lids other than those dispensed is avoided.

It is an object of the present invention to provide a dispenser for beverage container lids which dispenses a single lid without contamination of the lid supply by contact with a user's hands.

It is another object of the present invention to provide a lid dispenser which dispenses single lids in response to a pull on a handle.

It is also an object of the present invention to provide a lid dispenser which may be loaded through the same opening as lids are dispensed.

It is a further object of the present invention to provide a lid dispenser which will repeatedly dispense lids untended and with minimal maintenance.

Further objects, features, and advantages of the invention will be apparent from the following detailed description when taken in conjunction with the accompanying drawings.

DESCRIPTION OF THE PREFERRED EMBODIMENT

Figure 1:
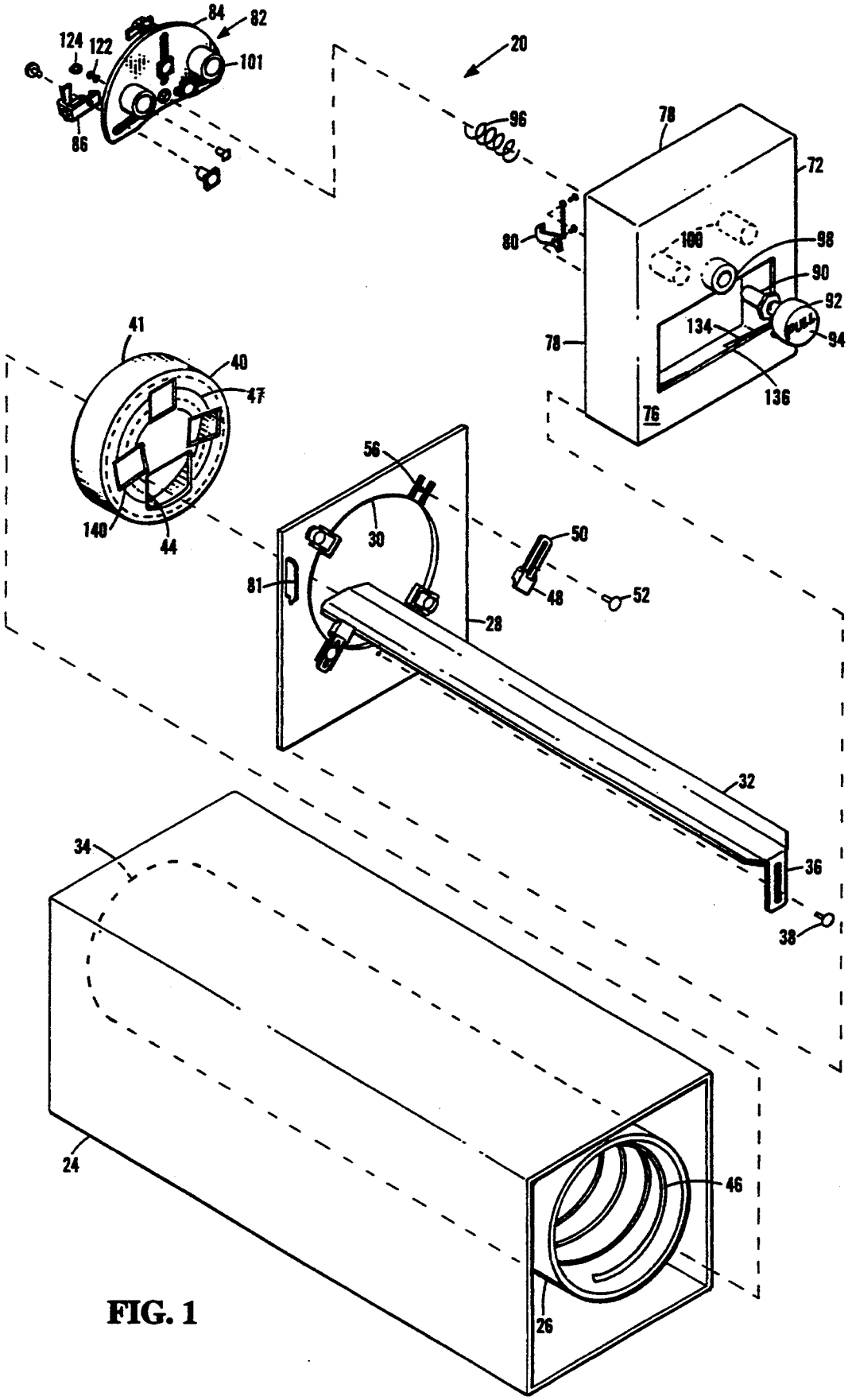
FIG. 1 is an exploded isometric view of the lid dispenser of this invention.

Referring more particularly to FIGS. 1–12 wherein like numbers refer to similar parts, a lid dispenser 20 is shown in FIG. 1. The dispenser 20 is configured to repeatably dispense individual ranged container lids 22 on the demand of a user in such a way that each user touches only the dispensed lid. The dispenser 20 may be adjusted and reconfigured to accept and dispense lids of varying dimensions.

Figure 2:
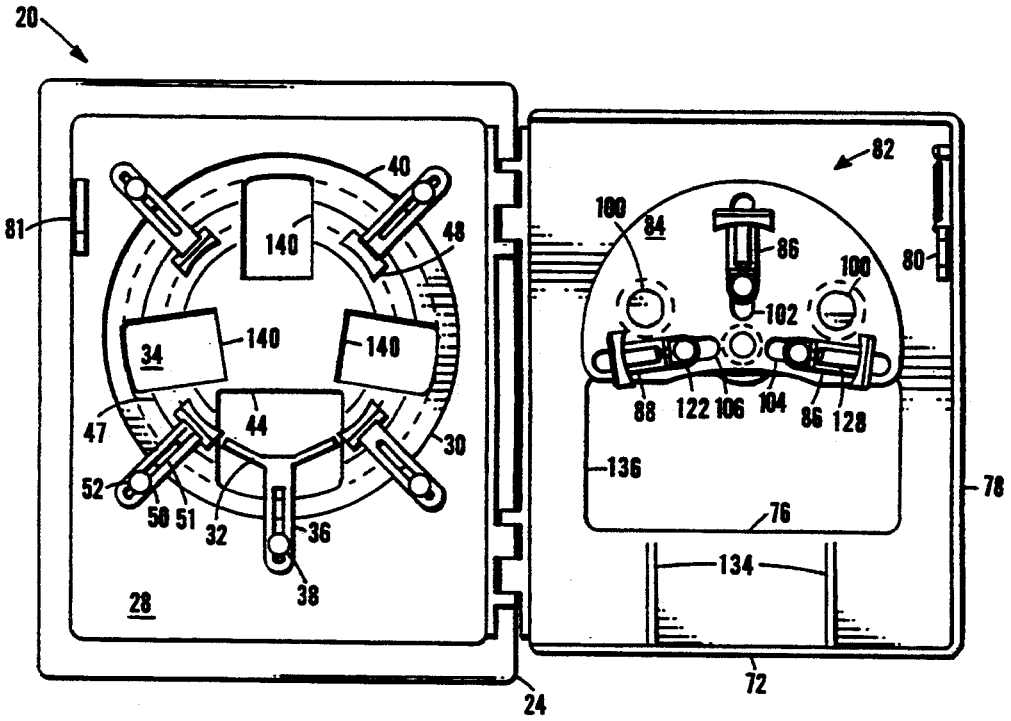
FIG. 2 is a front elevational view of the apparatus of FIG. 1 with the cover opened.

The dispenser 20 has a box-like housing 24 which may be positioned on a counter or mounted within a cabinet. A cylindrical lid supply tube 26 is fixed within the housing 24 rearward of the housing front wall 28. The housing front wall defines a circular lid dispensing opening 30 through which dispensed lids are discharged from the supply tube 26. As shown in FIG.2, a three-walled upwardly-opening trough-like lid support piece 32 is positioned within the supply tube 26 and extends from the front wall 28 to the rear wall 34 to the lid supply tube 26. The lid support piece 32 has a tab 36 which extends downwardly adjacent the housing front wall 28 and which is connected to the housing and held in place at a desired position by an adjustment screw 38. The lid support piece is fixed in place to the rear wall 34 of the supply tube 26.

A lid dispensing plate 40 is positioned within the supply tube 26 rearward of the stack 42 of lids supported on the support piece 32. The lid dispensing plate 40 has a lower slot 44 through which the lid support piece extends and a cylindrical collar 41 which extends rearwardly from the plate. A coiled spring 46 extends between the rear wall 34 of the supply tube 26 and the lid dispensing plate 40 and biases the dispensing plate against the rear of the stack 42 to urge the lids toward the lid dispensing opening 30. The spring is retained within the plate collar 41, and the collar restricts undesired tilting of the plate 40. To assist in centering a stack of lids against the plate 40, the plate is provided with indicia 47 in the form of concentric circles. The indicia 47 may be affixed by such means as silk-screen printing.

Figure 8:
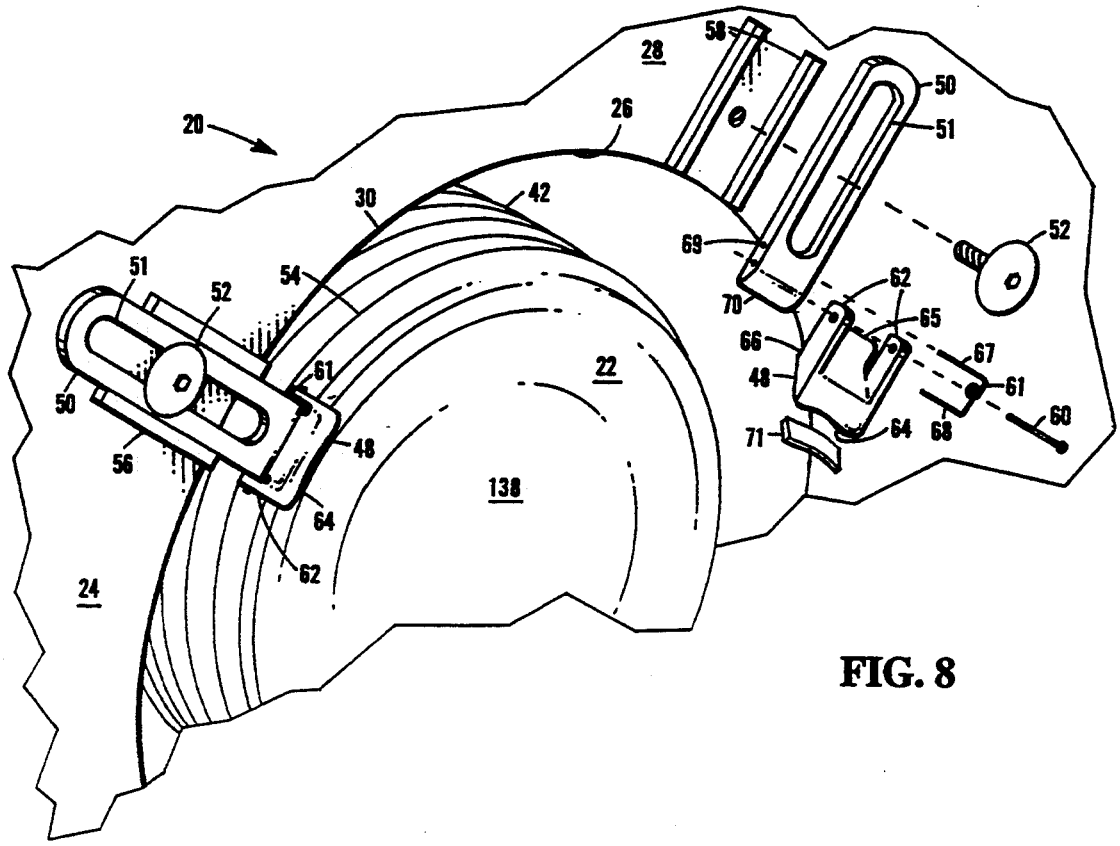
FIG. 8 is a partly exploded fragmentary isometric view of the apparatus of FIG. 1.
Figure 9:
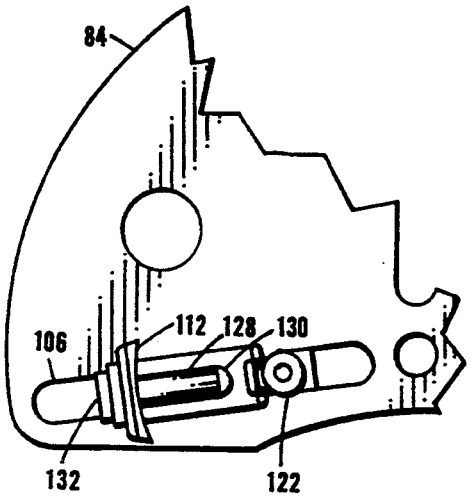
FIG. 9 is a fragmentary rear elevational view showing the break-away claw of the apparatus of FIG. 1.

As shown in FIG. 8, four lid restraint members or pagers 48 are pivotably mounted adjustable arms 50 which extend radially into the space immediately frontward of the dispensing opening 30. Each pager and 50 has a radial slot 51 through which an adjustment screw 52 extends into the front wall 28 of the housing. The slot 51 permits the pager to be positioned on the pager arm 50 with respect to the lids carried on the lid support piece to properly engage with the flange 54 of the frontmost lid of the stack. Each pager arm 50 is constrained to move only radially by a pager guide 56 which has two parallel ridges 58 which guide the movement of the pager arm.

Each pager 48 is formed of molded polycarbonate plastic and is pivotably mounted on a metal pin 60 which extends through the pager arm 50. A torsion spring 61 extends between each pager 48 and the pager arm 50.

Each pager 48 has two wings 62 which extend radially outwardly from a narrow curved lip 64. The metal pin 60 extends through the wings 62. A narrow planar stop 65 extends from the sidewall 66 of the pager beneath the pager arm 50 and engages with the pager arm. The stop 65 prevents the pager 48 from pivoting frontwardly about the pager arm 50, yet does not interfere with inward pivoting of the pager.

Figure 12:
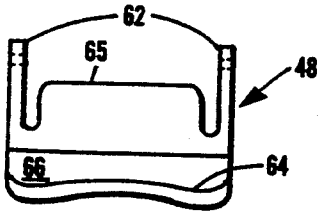
FIG. 12 is rear elevational view of a single pager of the apparatus of FIG. 1.

As shown in FIG. 12, each pager presents a rigid, unyielding lip 64 to the frontmost lid in the stack which is urged frontwardly by the lid plate 40. However, when loading lids into the supply tube, the pagers pivot rearwardly on the pins 60, and are returned to their original positions by the springs 61. The torsion springs 61 have noncoiled segments 67, 68 which engage within a bore 69 in the pager arm and with the pager sidewall 66 respectively.

To more effectively grip lids, a resilient strip 71 of polyurethane is adhesively attached to the curved pager sidewall 66.

In cases where it becomes necessary to remove an entire stack of lids from the supply tube without dispensing individually, each pager may be pivoted frontwardly to bring the stop 65 around the pager arm 50, and the stack removed without interference with the pagers. This forward pivoting of the pagers requires sufficient force to flexibly deform the polycarbonate. Such a force is greater than that which can be applied by the lids and the lid supply plate. To aid in repositioning the pagers after they have been pivoted frontwardly, the front inner corner of each pager arm 50 defines a curved cam surface 70 over which the stop 65 travels.

Figure 3:
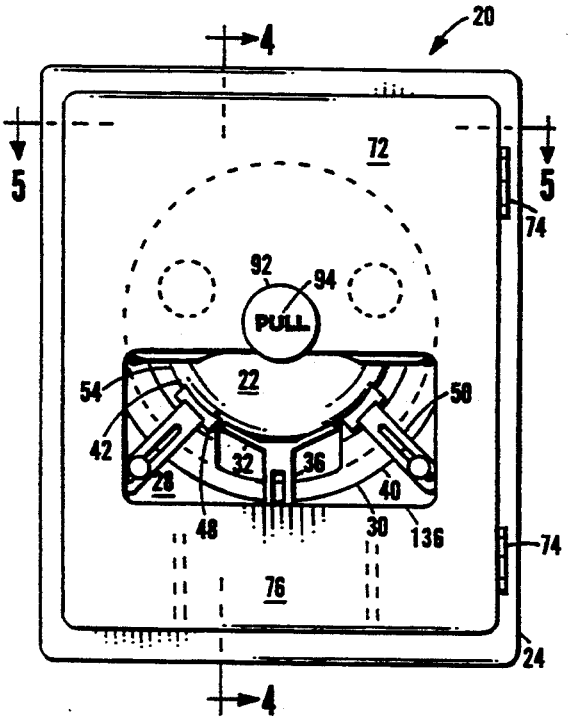
FIG. 3 is a front elevational view of the apparatus of FIG. 1 with the cover closed.

As shown in FIGS. 2 and 3, a rigid box-like cover 72 is mounted to the front wall 28 of the housing 24 by two plastic hinges 74. The cover 72 has a vertical front wall 76 which is preferably formed of transparent plastic such as a break-resistant acrylic under the brand name Implex, manufactured by Rohm & Has, to allow the user to view the lids to be dispensed. Four side walls 78 extend rearwardly from the front wall 76 and engage against the housing front wall 28 when the cover is closed. The cover 72 is pivotable on the hinges 74 between a closed position, shown in FIG. 3, in which the dispenser 20 is ready for use, and an open position, shown in FIG. 2, for loading of the dispenser with lids. The cover 72 is held in the closed position by a spring-loaded hook 80 and catch 81 shown in FIG. 5. The hook 80 engages with a catch 81 mounted to the front wall 28 of the housing 24.

Figure 4:
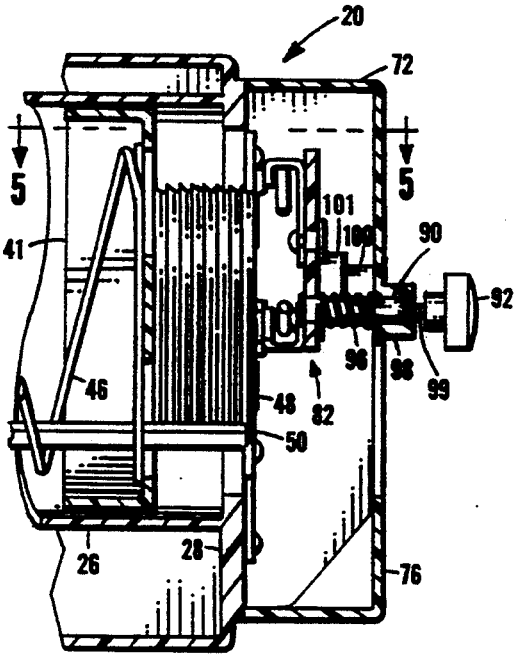
FIG. 4 is a cross-sectional view of the apparatus of FIG. 3 taken along section line 4—4.

Lids 22 are held positioned against the pagers 48 by the spring 46 and dispensing plate 40. Individual lids 22 are removed from a stored position by an extractor assembly 82 which is mounted to the cover 72 for front-to-back movement. The extractor assembly 82 consists of a claw support member 84 to which are mounted three adjustably positionable extractor claws 86, 88. The extractor assembly 82 is mounted on an actuator rod 90 which extends through the cover front wall 76. A handle 92 is attached to the actuator rod 90 in front of the front wall 76, and is marked with indicia 94 providing instructions for use of the dispenser, i.e., the word "PULL." As shown in FIG. 4, a coiled spring 96 extends between the front wall 76 of the cover and the claw support member 84. The spring 96 biases the extractor assembly 82 rearwardly into engagement with the frontmost lid 22 of a stack 42. The actuator rod 90 is threaded and extends through a plastic guide collar 98, shown in FIG. 3. A hex nut 99 is threaded on the rod 90 to permit adjustment of the depth of travel of the extractor assembly 82, by adjustment of the length of the rod 90 and handle 92 assembly.

As shown in HG. 5, two support posts 100 extend rearwardly from the cover front wall 76 and extend through annular plastic collars 101 which are affixed to the front of the claw support member 84. The collars 101 serve as bearings as the extractor assembly 82 travels on the support posts 100.

Figure 11:
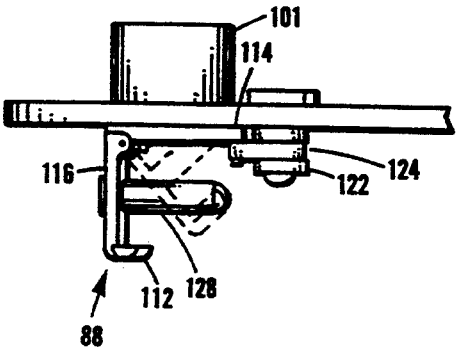
FIG. 11 is a top plan view of the break-away claw of FIG. 9.

As shown in HG. 7, the three claws 86, 88 are mounted for radial adjustment in three radially extending slots 102, 104, 106. The upper slot 102 extends vertically, with a side slot 104 located at 98° from the vertical and the other side slot 106 located at 262° from the vertical. The claws 86 in the upper slot 102 and the side slot 104 are of a fixed configuration and have an L-bracket shaped body composed of a base 108 which is wider than the slot. and a rearwardly extending arm 110. A curved rim 112 extends inwardly from each arm 110 The rims 112 are flat plates which pass over a lid and engage behind its flange 54. The claw 88 which is in the slot 106 closest the hinges 74, is formed of a body having a pivotably connected base 114 and arm 116, to permit the arm to break away and fold frontwardly, as shown in FIG. 11, when the cover 72 is closed and the claw encounters the lid stack. When the cover is closed the claw 88 remains folded frontwardly. A spring 118 extends between the base 114 and arm 116 to bias the arm rearwardly. To restore the arm 116 to a rearward orientation, the pull handle is pulled rearwardly once the cover 72 is closed on the housing 24. This resets the claw 88 to a proper position engaged with the frontmost lid.

Plastic screws 119 are positioned on the front of the claw support member 84 and extend through the slots 102, 104, 106 to engage loosely with the claw bases 108, 114. Nubs 120 extend rearwardly from each claw base. Positionable two-part fasteners 122 serve as claw stops and are positioned in the slots 102, 104, 106 and tightened in place to set the desired radial position of the claws 86, 88. Resilient bands 124 are looped between each fastener 122 and the claw nub 120 in the same slot. The bands 124, which may be of rubber or resilient plastic, allow slight tilting and radially outward movement of the claws as the extractor assembly moves into engagement with a lid 22.

Narrow slots 126 are formed in each claw arm 110, 116 and positionable depth stops 128 are mounted in the slots 126 and extend radially inwardly from the arms 110, 116. The depth stops 128 are plastic cylinders attached by fasteners 130 to nuts 132 on the outward sides of the arms. The depth stops 128 engage against the front of a lid 22 when the extractor assembly 82 is released. The stops 128 arc adjustable from front to mar to accommodate the particular spacing between the front of a lid 22 and the lid flange 54.

As shown in HG. 4, two plastic triangular gussets 134 are affixed to the cover 72 between the cover lower side wall 78 and the cover front wall 76. The gussets 134 are in the path of a dispensed lid 22 and direct the lid so it protrudes out a rectangular lid removal opening 136 formed in the front wall of the cover 72 beneath the actuator handle 92.

Figure 5:
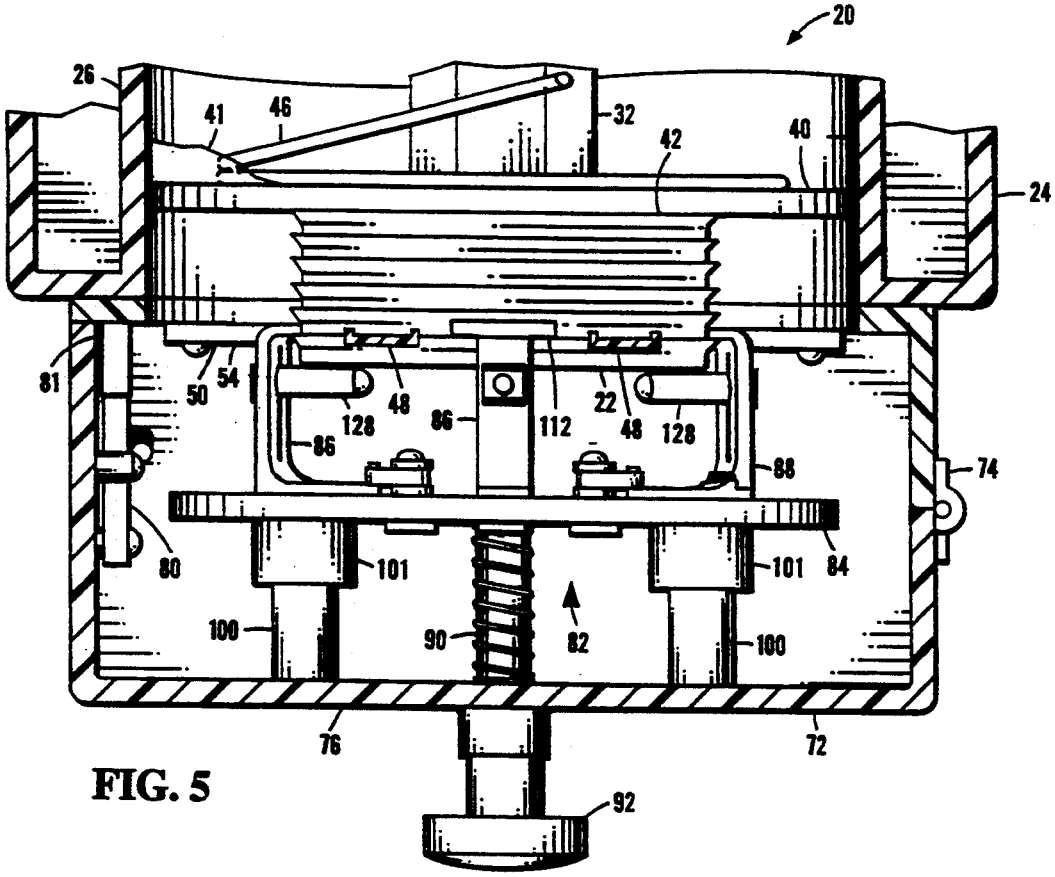
FIG. 5 is a cross-sectional view of the apparatus of FIG. 4 taken along section line 5—5, showing the actuator in a retracted position.
Figure 6:
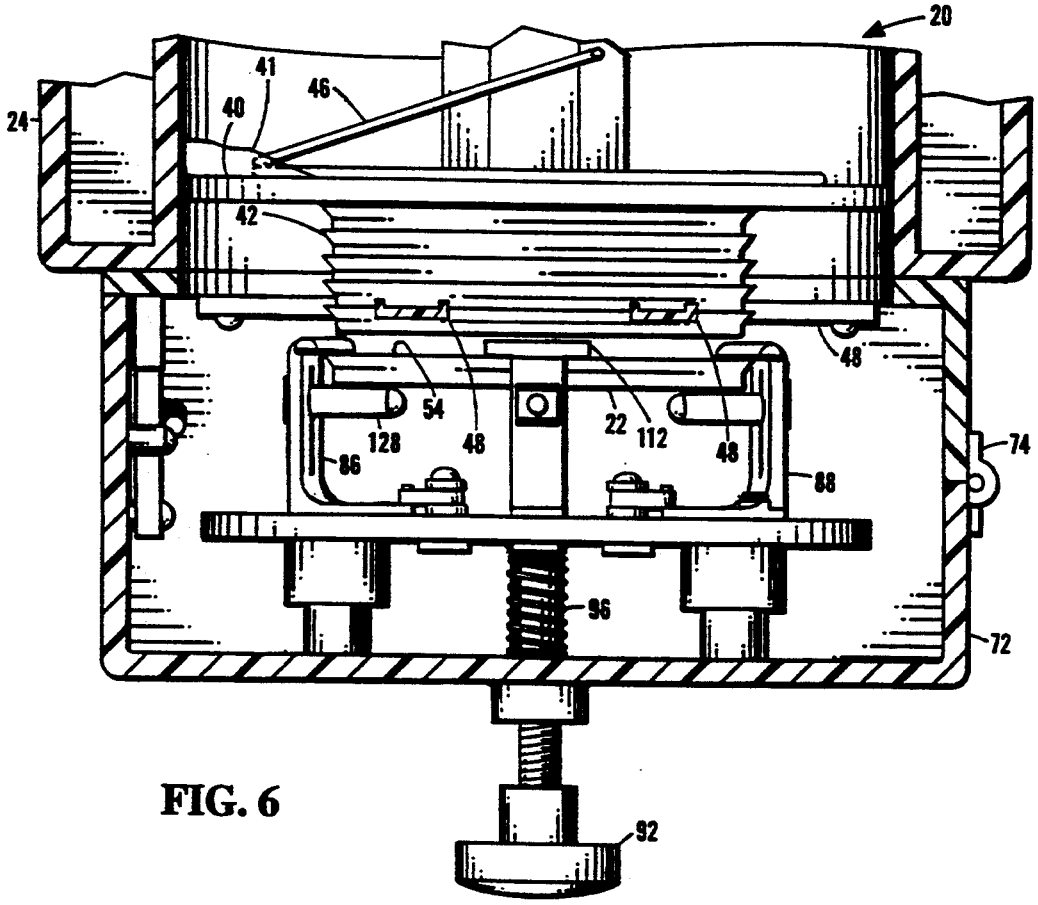
FIG. 6 is a cross-sectional view of the apparatus of FIG. 5 with the actuator shown in a retracted position.
Figure 7:
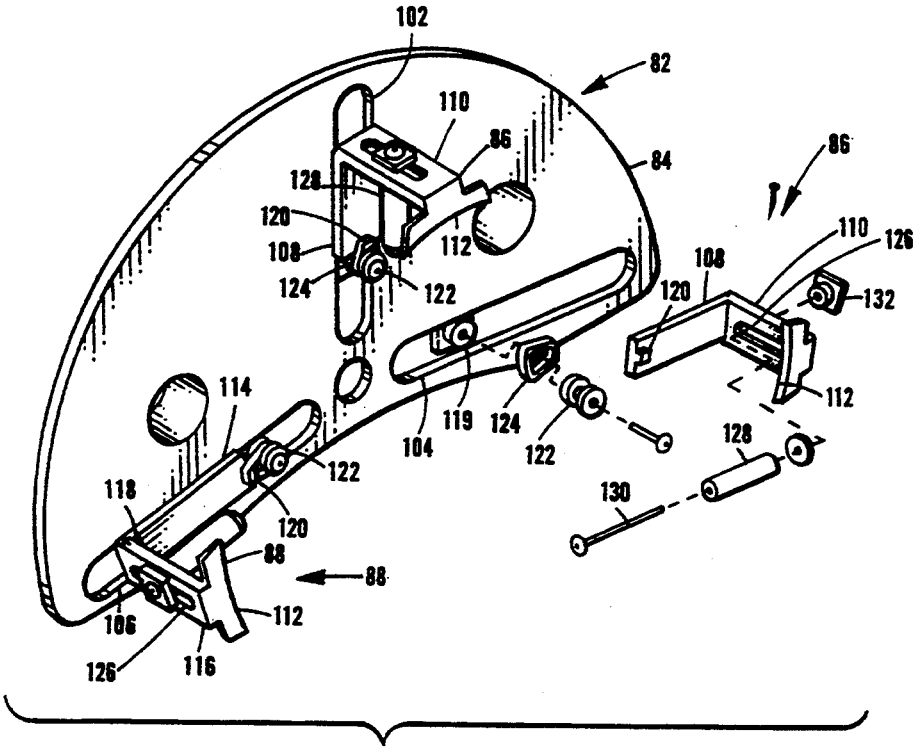
FIG. 7 is an isometric view, partly exploded, of the claw assembly of the apparatus or FIG. 1.

The operation of the dispenser 20 is illustrated in FIGS. 5 and 6. When the handle 92 has not been pulled, the dispenser is in its unactuated condition. The extractor assembly 82 ts biased against the stack of lids 22, as shown in FIG. 5. The lips 64 of the pagers are engaged against the front of the flange 54 of the frontmost lid 22, and the rims 112 of the three claws 86, 88 are engaged with or closely spaced from the rear of the same flange 54. The depth stops 128 are engaged against the front 138 of the lid.

When the handle 92 is pulled, the extractor assembly 82 begins to move frontwardly, causing the somewhat flexible plastic lid 22 to deform. More particularly, the flange 54 of the frontmost lid 22 is bent to clear the pagers 48, and is effectively pulled by the claw rims 112 forward and separated from the stack 42 as shown in FIG. 6. The arms of the side claws 86, 88 do not interfere with the downward motion of the extracted lid 22. Hence, once free from the stack 42, the lid 22 falls downwardly from the extractor assembly 82 to engage the gussets 134 and be positioned for grasping by a customer through the lid removal opening 136.

When the stack 42 has been depleted to only one lid 22, the claws 86, 88 will extend into three clearance openings 140 in the lid dispensing plate 40 so the rims 112 are able to reach behind the lid flange 54.

Figure 10:
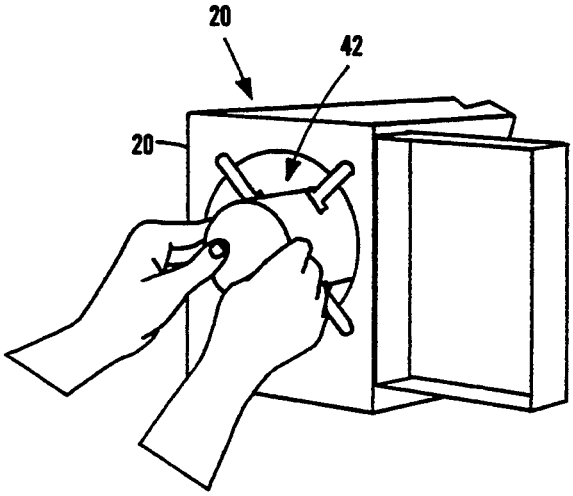
FIG. 10 is a simplified perspective view of a stack of lids being inserted in the apparatus of FIG. 1.

Once the stack 42 has been exhausted, the dispenser is loaded, as shown in FIG. 10, by opening the cover 72, aligning the new stack 42 with the appropriate circular indicia 47, and pressing the stack into the supply tube 26 past the pagers 48 which bend rearwardly with applied pressure. The loading technique is sufficiently simple that an untrained operator may effectively load the dispenser 20 with substantially no instruction.

The complete adjustability of the dispenser 20 permits it to be used for dispensing lids of a wide range of sizes. Typically a dispenser might be called on to dispense lids for beverage containers from eight fluid ounces to forty-four fluid ounces. At the time of installation of the dispenser 20, a technician will adjust the position of the lid support piece 32 up or down, the radial position of the pagers 48, the pull length of the actuator rod 90, the radial position of the positionable fasteners 122, and the depth of the depth stops 128. Once set, the adjustments need not be interfered with until it is desired to load the dispenser with a different type of lid. Lid dimensions vary not only with respect to size of container, but also from manufacturer to manufacturer.

It should be noted that although the dispenser 20 has been illustrated as a stand-alone housing unit, it may also be fitted within a cabinet, in which case the cabinet will function as the housing for the dispenser. Furthermore, although the plastic portions of the dispenser have been illustrated as opaque for clarity in the illustrations, for better visibility of the dispensed lids, the extractor assembly and the pagers and pager arms may be fabricated of transparent plastic.

It is understood that the invention is not confined to the particular construction and arrangement of parts herein illustrated and described, but embraces all such modified forming thereof as come within the scope of the following claims.

I claim:

1. An apparatus for dispensing container lids having peripheral flanges, the apparatus comprising:

a) a housing having portions defining a lid dispensing opening;

b) a lid support member which is fixed within the housing and which supports a stack of a plurality of lids thereon;

c) a plate positioned with respect to the support member to engage the lids supported thereon;

d) a spring which engages against the plate and biases the lids toward the dispensing opening;

e) a plurality of lid restraint members which extend from the housing frontwardly of the plate and engage with a frontmost lid of the stack;

f) a cover positioned frontwardly of the housing and having a lid removal opening which is frontward of the housing lid dispensing opening;

g) a rod which extends through the cover and which is graspable frontwardly of the cover by a user;

h) a claw support member which is fixed to the rod;

i) a spring which extends between the claw support member and the cover, wherein the spring biases the claw support member toward the housing lid dispensing opening; and j) a plurality of claw members mounted to the claw support member radially outwardly from the rod, wherein each claw member is resiliently connected to the support member to permit movement in a radial direction, and wherein the claw members are engageable with a lid flange of a frontmost lid, and wherein the rod is retractable to disengage a frontmost lid from the stack and discharge said lid for removal through the cover lid removal opening.

2. The apparatus of claim 1 further comprising:

a) a plurality of support rods extending rearwardly from the cover; and b) portions of the claw support member which define collars which surround the support rods such that the movement of the claw support member is guided by the support rods.

3. The apparatus of claim 1, further comprising:

a) a rigid arm positionably fixed to the housing and extending radially inwardly and frontwardly of the housing lid dispensing opening, wherein the lid restraint member is pivotably connected to the arm; and c) a spring which extends between the lid restraint member and the arm, wherein the lid restraint member is biased frontwardly by the spring, such that the lid restraint member remains fixed with respect to the arm when lids are urged frontwardly against the lid restraint member, but the lid restraint member pivots rearwardly when a stack of lids is inserted into the apparatus through the lid dispensing opening.

4. The apparatus of claim 1 further comprising:

a) portions of the claw support member which define a plurality of radially extending slots;

b) a stop nut positionably located within each slot, wherein a claw is positioned for radial displacement within each slot; and c) a resilient band extending between each stop nut and claw within each slot, wherein the claws may thereby move radially outwardly and may tilt with respect to the claw support member.

5. The apparatus of claim 1 wherein the lid support member has a downwardly extending tab with portions defining a vertical slot and a fastener extends through the slot into the housing, and wherein the position of the support member may be adjusted vertically by positioning the tab with respect to the housing.

6. An apparatus for dispensing container lids having peripheral flanges, the apparatus comprising:

a) a housing having portions which support a stack of lids;

b) a biasing member disposed between the housing and the stack, wherein the biasing member urges the stack frontwardly;

c) a plurality of lid restraint members which extend from the housing frontwardly of the stack, wherein the biasing member urges the stack against the lid restraint members, and wherein each lid restraint member engages the peripheral flange of a lid frontmost in the stack;

d) a cover mounted to the housing to extend frontward of the lid restraint members: and e) an extractor assembly mounted to the cover frontward of the housing for movement toward and away from the stack of lids engaged by the restraint members; wherein the extractor assembly has a plurality of claw members mounted resiliently such that when the extractor assembly is moved toward the stack of lids, the claw members ride over the flange of the frontmost lid and are disposed rearward of said flange, and such that frontward movement of the extractor assembly extracts a container lid from engagement with the lid restraint members.

7. The apparatus of claim 6 wherein the biasing member includes a plate which engages against the rear of the lid stack, and wherein the plate has indicia thereon which depict a plurality of concentric circles to aid in the positioning of a stack of lids within the apparatus.

8. An apparatus for dispensing container lids having peripheral flanges, the apparatus comprising:

a) a housing having portions which support a stack of lids;

b) a biasing member disposed between the housing and the stack, wherein the biasing member urges the stack frontwardly;

c) a plurality of lid restraint members which extend from the housing frontwardly of the stack, wherein the biasing member urges the stack against the lid restraint members, and wherein each lid restraint member engages the peripheral flange of a lid frontmost in the stack; and d) an extractor assembly mounted to the housing for movement toward and away from the stack of lids engaged by the lid restraint members; wherein the extractor assembly has a plurality of claw members mounted resiliently such that when the extractor assembly is moved toward the stack of lids, the claw members ride over the flange of the frontmost lid and are disposed rearward of said flange, and such that frontward movement of the extractor assembly extracts a container lid from engagement with the lid restraint members wherein the biasing member includes a plate which engages against the lid stack, and wherein portions of the plate define a plurality of clearance holes, one clearance hole corresponding to each of the claw members, such that when the plate is engaged with the frontmost lid, portions of the claw members may extend rearwardly of the plate through the clearance holes to engage the frontmost lid.

9. An apparatus for dispensing lids having peripheral flanges, the apparatus comprising:

a) a housing having portions which define a lid dispensing opening, wherein the housing has portions which support a stack of lids for dispensing through the lid dispensing opening;

b) a plurality of rigid arms connected to the housing and extending in front of the lid dispensing opening;

c) a lid restraint member pivotably connected to each arm, wherein the lid restraint members engage against a frontmost lid of the lid stack;

d) a spring which extends between the lid restraint member and the arm, wherein the lid restraint member is biased frontwardly by the spring, such that the lid restraint member remains fixed with respect to the arm when lids are urged frontwardly against the lid restraint member, but the lid restraint member pivots rearwardly when a stack of lids is inserted into the apparatus through the lid dispensing opening; and e) means for extracting a lid from its engagement with the lid restraint members, wherein the means is mounted to the housing frontwardly of the lid supporting portions.

10. The apparatus of claim 9 wherein a rigid stop extends from each lid restraint member rearward of the arm, and wherein the stop engages against the connected rigid arm when a stack of lids is biased against said lid restraint member.

11. The apparatus of claim 10 wherein the arm further comprises a curved cam surface on a front face of the arm, and wherein the stop extends from the lid restraint member such that the lid restraint member may be forcibly pivoted to cause the stop to traverse the cam surface and remain in a forward position which is not engaged with the lid.

12. The apparatus of claim 9 wherein each lid restraint member has a lip which extends inwardly for engagement against a lid flange.

13. The apparatus of claim 9 further comprising a strip of resilient material affixed to each lid restraint member to engage with a lid.

14. The apparatus of claim 9 further comprising two parallel radially extending ridges connected to the housing adjacent each arm, wherein the arm is positionable radially within the ridges.

15. A dispenser for flexible container lids having a periphery, the dispenser comprising:

a) a housing;

b) a lid support connected to the housing which supports a plurality of container lids in a stack;

c) a spring which urges the lid stack frontwardly;

d) projections frontward of the lid stack which are connected to the housing and which restrain the frontward motion of the lid stack, wherein the projections permit access to at least a portion of the periphery of a frontmost lid in the stack;

e) a claw support member mounted to the housing frontward of the lid stack, and mounted for motion toward and away from the frontmost lid; and f) a plurality of claws connected to the claw support member, wherein each claw has an arm which extends rearwardly from the claw support member and a rim mounted to the arm spaced from the claw support member and wherein frontward displacement of the claw support member positions the rims rearward of the frontmost lid, and subsequent frontward displacement of the claw support member extracts the frontmost lid from engagement with the lid restraining projections.

16. The dispenser of claim 15 further comprising:

a) portions of the claw support member which define three slots, wherein the slots extend radially outwardly;

b) a base formed frontward of each claw arm, wherein each claw base is engaged for slidable motion within a slot;

c) a positionable fastener fixed within each slot; and d) a resilient band which extends between each claw base and a positionable fastener, wherein the bands bias the claw rims radially inwardly, but permit radially outward deflection of the claws.

17. The dispenser of claim 15 further comprising a depth stop positionably connected to each claw arm at a location rearward of the claw support member, wherein the depth stops engage against a front surface of the frontmost lid when the claw support member is in its rearmost position.

18. The dispenser of claim 15 further comprising:

a) a cover positioned frontwardly of the housing;

b) at least one hinge extending between the cover and the housing, wherein the claw support member is mounted to the cover, and wherein the claw closest to the hinge is a break-away claw which has a base which is connected to the claw support member and a claw arm which is pivotably connected to the base; and c) a spring which extends between the break-away claw arm and base, wherein the spring biases the arm to extend rearwardly, and wherein interference between the break-away arm and portions of the dispenser when the cover is closed on the housing will cause the arm to pivot, and then return to its original position when the interference is no longer present.

* * * * *